United States Patent [19]

Antonious

[11] Patent Number: 5,004,237

[45] Date of Patent: Apr. 2, 1991

[54] PUTTER WITH L-SHAPED HOSEL

[76] Inventor: Anthony J. Antonious, 205 E. Joppa Rd., Towson, Md. 21204

[21] Appl. No.: 364,085

[22] Filed: Jun. 9, 1989

[51] Int. Cl.[5] ..... A63B 53/02

[52] U.S. Cl. ..... 273/80.2; 273/167 F; 273/169

[58] Field of Search ..... 273/167–175, 273/164, 80.2–80.9, 77 A, 77 R; D21/217–219

[56] References Cited

U.S. PATENT DOCUMENTS

| | | | |
|---|---|---|---|
| D. 197,725 | 3/1964 | Miartuz | 273/78 X |
| D. 254,084 | 1/1980 | Hulyk | D21/217 |
| D. 293,927 | 1/1988 | Antonious | D21/218 |
| D. 294,377 | 2/1988 | Antonious | D21/217 |
| 1,952,624 | 3/1934 | Inman et al. | 273/167 R |
| 2,530,446 | 11/1950 | Beardsley | 273/168 X |
| 3,595,582 | 7/1971 | Chapman | 273/164 X |
| 4,147,357 | 4/1979 | Strop | 273/167 R X |
| 4,174,108 | 11/1979 | Reinholz | 273/168 X |
| 4,506,888 | 3/1985 | Nardozzi | 273/80.1 |
| 4,693,478 | 9/1987 | Long | 273/164 |
| 4,844,468 | 7/1989 | Lee | 273/163 R |

FOREIGN PATENT DOCUMENTS

| | | | |
|---|---|---|---|
| 652592 | 4/1951 | United Kingdom | 273/167 B |

*Primary Examiner*—Edward M. Coven
*Assistant Examiner*—Sebastiano Passaniti
*Attorney, Agent, or Firm*—N. J. Aquilino

[57] ABSTRACT

A putter type golf club head configuration including a shaft connector, a club head body having a heel, toe, ball striking face, upper and lower surfaces and a hosel connecting the shaft connector to the body and including a vertical hosel member and a horizontal base member disposed in a perpendicular direction to the vertical hosel member and extending along the upper surface of the club head body.

7 Claims, 2 Drawing Sheets

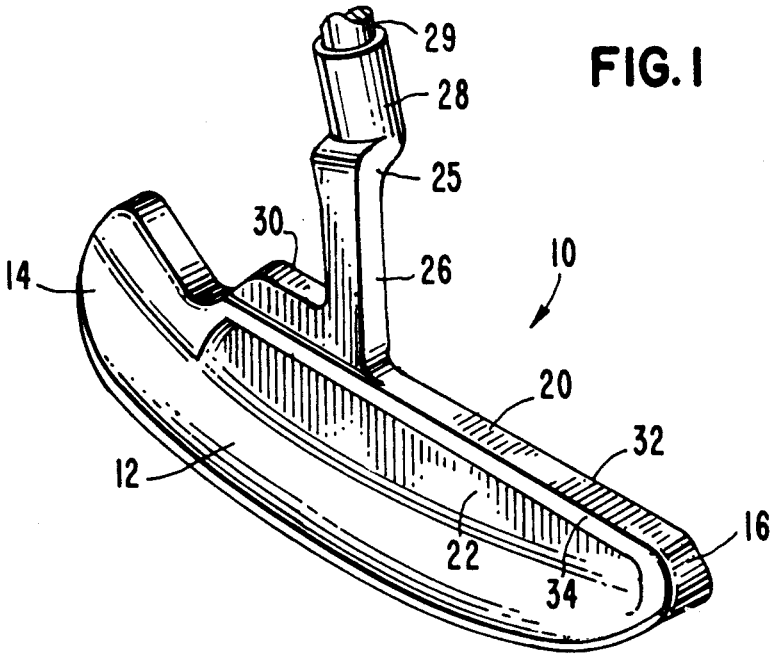
FIG. 1
FIG. 2
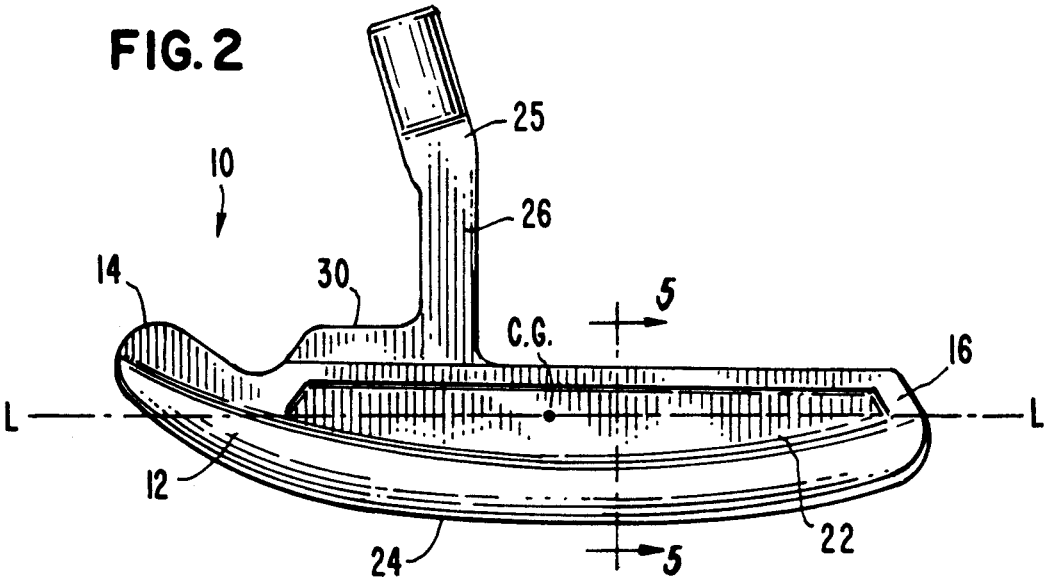
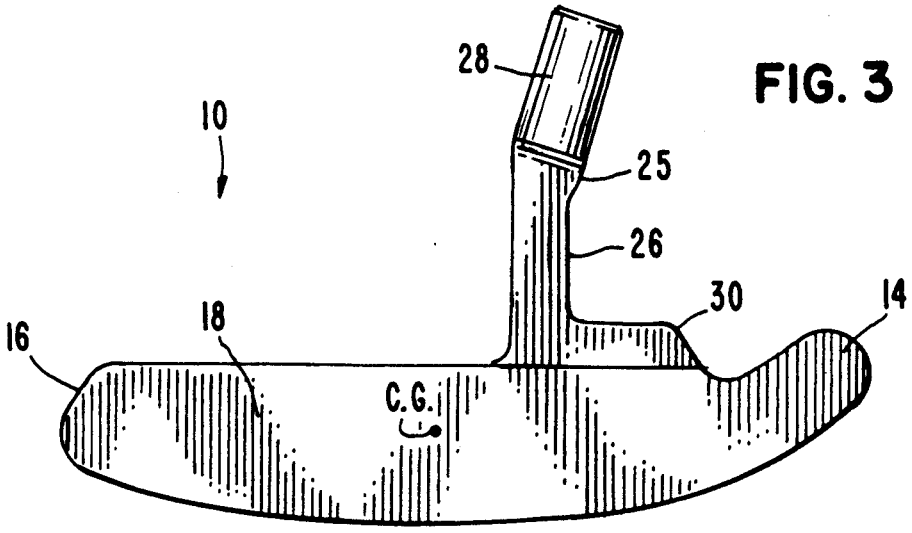
FIG. 3

PUTTER WITH L-SHAPED HOSEL

BACKGROUND OF THE INVENTION

The present invention relates to putter type golf club heads and in particular to an improved putter type golf club head having a novel hosel structure.

The connection between a club head and the shaft is made with a hosel which includes a shaft socket or an in-shaft connector. Conventional hosels are generally perpendicular to the longitudinal axis of the club head body and are connected thereto along the top ridge of the club head. Various connections are well known in the prior art wherein the connection is made at the heel, center and even the toe portion of the club head body. Other hosel connections are made on the side of the club head and at various angles in an attempt to provide various weight distributions and balances between the club head and the shaft.

SUMMARY OF THE INVENTION

The present invention uses an improved hosel structure including a horizontal base member and a vertical upper member which is connected to a shaft either through a shaft socket or in-shaft connector. The upper vertical member is perpendicular to the longitudinal axis of the club head body and is connected at a single point on the horizontal base member. The horizontal base member is perpendicular to the upper vertical hosel member and lies in a horizontal plane and has an upper surface free and unattached and a lower surface which is integrally attached to the top ridge of and overlays the club head body. This hosel structure creates a connection between the shaft and the club head body in a horizontal and longitudinal direction along the top of the club head body.

Several embodiments of the hosel are contemplated including a structure where the horizontal base member includes a toe component and a heel component which extend on both sides of the vertical member in a direction toward both the toe and the heel respectively; a structure where the horizontal base member extends from the vertical member toward the toe only; and, a structure where the horizontal base member extends from the vertical member toward the heel only. The different single or dual component hosel base member shapes are used to accommodate the various stroke characteristics of different players so that a particular player can use a putter which has more weight specifically located above the center of gravity (CG) to produce a more solid connection between the shaft and the club head body at the point where the player most often strikes the ball.

The hosel structure is contemplated for use with a variety of club head types and structures which include a top ridge or upper club head surface to accommodate the connection.

Among the objects of the present invention are an improved hosel structure for connecting the club head shaft to the club head body; the provision of a hosel structure which extends in the horizontal and vertical direction; the provision of a hosel structure which extends the connection point between the club head shaft and the body along the upper longitudinal axis of the club head body; and, the provision of a hosel structure which more efficiently transmits the forces between the shaft and the club head body creating a more even energy distribution to a struck golf ball.

Other objects will become apparent with reference to the accompanying drawings and specification.

DESCRIPTION OF THE DRAWINGS

FIG. 1 is a rear perspective view of a putter type golf club head of the present invention.

FIG. 2 is a rear elevational view thereof.

FIG. 3 is a front elevational view thereof.

DESCRIPTION OF PREFERRED EMBODIMENTS

Figure 6:
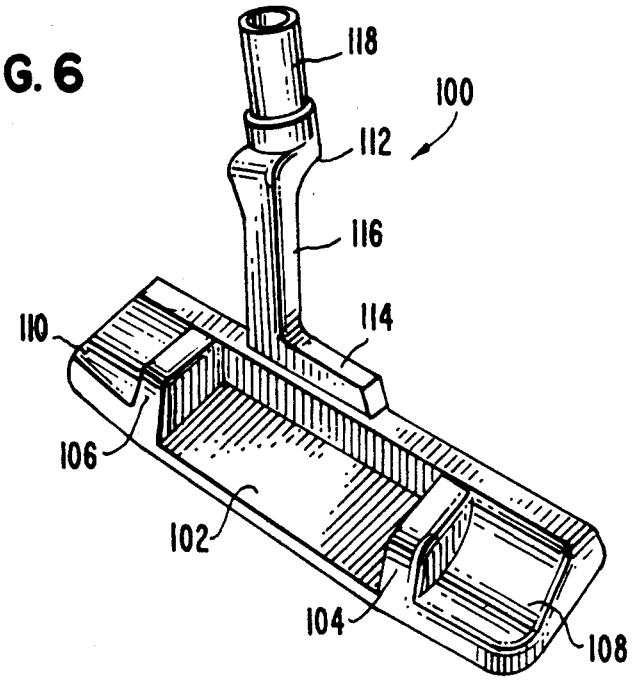
FIG. 6 is a rear perspective view of a second embodiment of the present invention.

FIGS. 1 to 5 illustrate a first embodiment of the putter type club head 10 of the present invention. The golf club head 10 includes a body 12 having a heel 14, toe 16, ball striking face 18 with a center of gravity (CG), a top ridge 20, a concave rear surface 22 and bottom 24. In this embodiment, the hosel 25 includes a vertical member 26 having a shaft socket 28 for a connection to a shaft 29 (partially shown in FIG. 1). The hosel 25 also includes a horizontal base member 30 which is perpendicular to the vertical member 26 forming an L-shaped configuration extending toward the heel 14 and which has a free and unattached upper surface 31 and the bottom of which is integrally attached to the top ridge 20 of the club head body 12 extending in a horizontal direction and generally parallel to the longitudinal axis of the club head 10. In this embodiment, the base member 30 of the hosel 25 forms a single component extending between the vertical hosel member 26 and the heel 14 of the club head 10.

Figure 4:
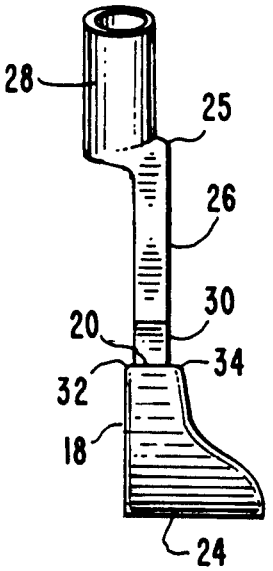
FIG. 4 is an end elevational view thereof.
Figure 5:
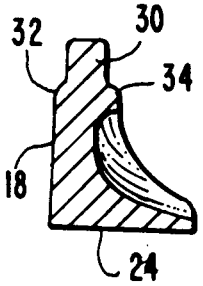
FIG. 5 is a sectional view taken along the lines 5—5 of FIG. 2.

As can be seen in FIGS. 4 and 5, the width of the base member 30 is less than the distance between the front and rear edges 32 and 34 of the top ridge 20. Also the height of the base member 30 is approximately the same as the horizontal width of the vertical member 26 to provide symmetry between the parts and to insure maximum efficiency in the transfer of force between the shaft 29 and the club head body 12.

It will be appreciated that the exact dimensions of the hosel 25 are not critical in keeping within the overall shape of the hosel structure. Various lengths and widths of both the horizontal base member 30 and the vertical member 26 may be used to provide the connection between the hosel 25 and the club head body 12.

The putter of this embodiment provides a more solid connection between the hosel 25 and the club head body 12 toward the heel 14 and is particularly adapted for players who strike a ball toward the heel 14 during a normal putting stroke.

FIG. 6 illustrates a second embodiment of a putter type club head 100 of the present invention. The putter head 100 includes a rear cavity 102 separated by upstanding weight members 104 and 106 located adjacent the toe 108 and heel 110 respectively. A hosel 112 is also generally L-shaped and includes a single component horizontal base member 114, a vertical member 116 and an in-shaft type connector 118. In this embodiment, the horizontal base member 114 of the hosel 112 extends only between the vertical member 116 and the toe 108 of the club head 100. This putter structure provides a more solid connection toward the toe 108 of the club head 100 and is particularly adapted for players who would have a tendency to strike a ball toward the toe 108 of the club head 100.

Figure 7:
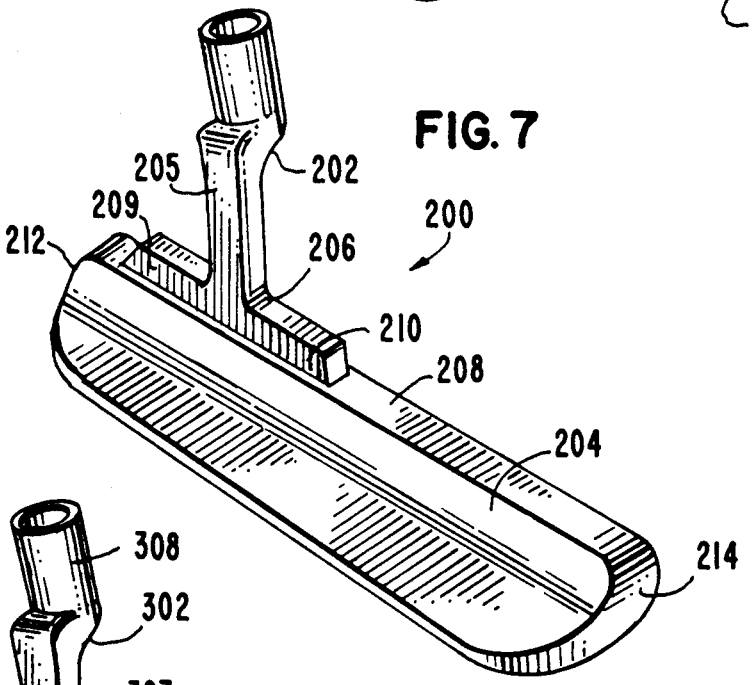
FIG. 7 is a rear perspective view of a third embodiment of of the present invention.

FIG. 7 illustrates a third embodiment of a club head 200 of the present invention. A hosel 202 connects a shaft (not shown) to a blade and flange type putter head body 204. The hosel 202 includes a vertical member 205 and a horizontal base member 206 which lies on the top ridge 208 of the putter head body 204. In this embodiment the base member 206 is formed of two substantially equal components 209 and 210 which are perpendicular to the vertical member 205. Heel component 209 of the base member 206 extends from the vertical member 205 toward the heel 212 of the club head body whereas toe component 210 of the horizontal base member 206 extends from the vertical member 205 toward the toe 214 of the club head body 204. The two components 209 and 210 of member 206 extend an equal distance on opposite sides of the point where the vertical member 205 of the hosel 202 is connected to the body 204 of the club head 200 to provide an equal weight distribution toward the toe 214 and heel 212 of the putter head body 204.

Figure 8:
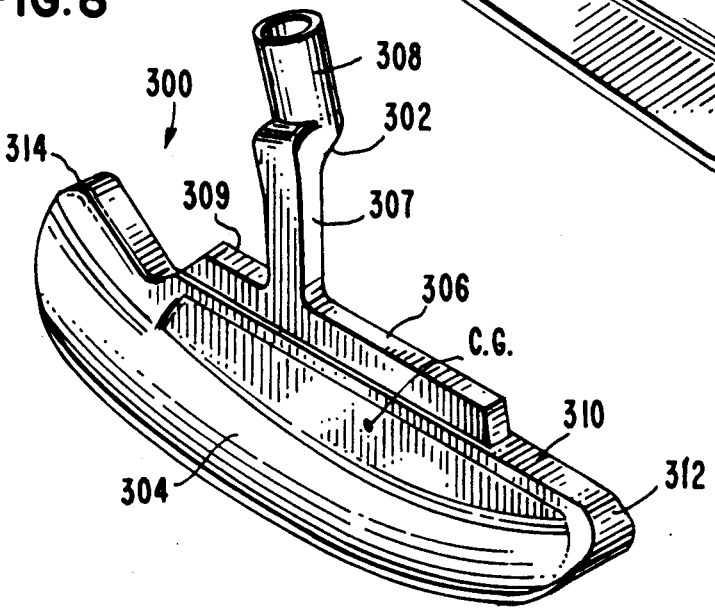
FIG. 8 is a rear perspective view of a fourth embodiment of the present invention.

FIG. 8 illustrates a fourth embodiment 300 of the present invention including a hosel 302 for connecting a shaft (not shown) club head body 304. In this embodiment the hosel 302 includes a horizontal base member 306 and a vertical member 307 connected to a shaft socket 308. The horizontal base member 306 includes a toe component 307 extending toward the toe 312 and a heel component 309 extending toward the heel 314 and is integrally formed with the top ridge 310 of the club head body 304. The toe component 307 is longer in its longitudinal length in a direction between the vertical member 307 and the toe 312 of the club head 300 than the heel component 209 in the opposite direction. This club head structure provides more weight specifically located above the center of gravity (CG) and near the toe 312 to produce a more solid connection for a golfer who tends to miss-hit the ball on the club head 300 toward the toe 312.

Therefore, it can be seen that the horizontal base member of the hosel can be formed at various locations along the top surface or the top ridge of a number of putter head designs to accommodate the different ball striking characteristics of a variety of players. The particular location of the horizontal base member of the hosel creates a more solid connection at a specific point where it has been determined a ball has generally been struck, in part by relocating the center of gravity (CG) because of the additional mass of the horizontal base member. This hosel structure not only provides more support or bracing to the vertical hosel member but produces a more solid connection between the shaft and the club head body and further provides additional weight at the specific predetermined location where a ball would be normally struck by a particular player.

It will be appreciated that the above description is illustrative only in that other modifications may be made in both the size and shape of the golf club head and in the size and structure of the hosel. Although the embodiments described are used with blade type putters having a top ridge, the invention is equally applicable to other shapes such as mallet heads or the like. Such changes may be made in keeping within the scope of the invention as defined in the following claims.

I claim:

1. A putter type golf club head having a shaft connecting means and a club head including a heel, toe, ball striking face and top ridge, wherein the improvement comprises:

a hosel for connecting said club head body to said shaft connecting means; said hosel including a vertical hosel member connected to said shaft connecting means and a horizontal hosel member connected and perpendicular to said vertical hosel member whereby 90 degree angle between said horizontal and vertical hosel members is formed; said horizontal hosel member lying above said top ridge and having an upper surface unattached to said club head body and a lower surface integrally formed with and attached to said top ridge of said club head body and providing an extended connection between said hosel and said club head body in the heel-to-toe direction of the club head; said horizontal hosel member being comprising a first component extending from said vertical hosel member toward said toe and a second component extending from said vertical hosel member toward said heel.

2. The club head of claim 1 wherein each of said first and second components are equal in length.

3. The club head of claim 1 wherein one of said first and second components is greater in length than the other.

4. The club head of claim 3 wherein said greater in length component extends from said vertical hosel member toward said toe.

5. A putter type golf club head having a shaft connecting means and a club head including a heel, toe, ball striking face and top ridge, wherein the improvement comprises:

a hosel for connecting said club head body to said shaft connecting means;

said hosel including a vertical hosel member connected to said shaft connecting means and a horizontal hosel member connected to and perpendicular to said vertical hosel member whereby a 90 degree angle between said horizontal and said vertical hosel members is formed;

said horizontal hosel member lying above said top ridge and having an upper surface unattached to said club head body and a lower surface integrally formed with and attached to said top ridge of said club head body and providing an extended connection between said hosel and said club head body in the heel to toe direction of the club head wherein said horizontal member further comprises a single component extending in a horizontal direction between said vertical member and said toe.

6. The club head of claim 5 wherein the height of said horizontal hosel member, extending above said top ridge, is approximately the same size as the width of said vertical hosel member in the heel-to-toe direction.

7. A putter type golf club head having a shaft connecting means and a club head including a heel, toe, ball striking face and top ridge, wherein the improvement comprises:

a hosel for connecting said club head body to said shaft connecting means;

said hosel including a vertical hosel member connected to said shaft connecting means and a horizontal hosel member connected to and perpendicular to said vertical hosel member whereby a 90 degree angle between said horizontal and said vertical hosel member is formed;

said horizontal hosel member lying above said top ridge and having an upper surface unattached to said club head body and a lower surface integrally formed with and attached to said top ridge of said club head body and providing an extended connection between said hosel and said club head body in the heel-to-toe direction of the club head wherein said hosel member further comprises a single component in a horizontal direction extending approximately midway between said vertical member and said heel.

* * * * *